US006336955B1

(12) United States Patent
Suzuki et al.

(10) Patent No.: US 6,336,955 B1
(45) Date of Patent: Jan. 8, 2002

(54) METHOD OF ELIMINATING PHOSPHORUS AND/OR ANTIMONY FROM MOLTEN ALUMINUM

(75) Inventors: Takao Suzuki; Naoto Oshiro, both of Yao (JP)

(73) Assignee: K.K. Daiki Aluminum Kogyosho, Yao (JP)

( * ) Notice: Subject to any disclaimer, the term of this patent is extended or adjusted under 35 U.S.C. 154(b) by 0 days.

(21) Appl. No.: 09/883,255

(22) Filed: Jun. 19, 2001

(30) Foreign Application Priority Data

Jun. 22, 2000 (JP) ..... 12-188171
Jun. 7, 2001 (JP) ..... 13-172897

(51) Int. Cl.[7] ..... C22B 21/06

(52) U.S. Cl. ..... 75/682; 75/685; 75/683; 75/684; 75/687

(58) Field of Search ..... 75/681, 682, 684, 75/685, 683, 687, 686

(56) References Cited

U.S. PATENT DOCUMENTS 4,312,849 A * 1/1982 Kramer ..... 423/348

FOREIGN PATENT DOCUMENTS

FR 2.050.886 * 4/1971 ..... 75/685

* cited by examiner

*Primary Examiner*—Melvyn Andrews
(74) *Attorney, Agent, or Firm*—Oblon, Spivak, McClelland, Maier & Neustadt, P.C.

(57) ABSTRACT

An improved method of eliminating phosphorus and/or antimony from molten aluminum containing phosphorus and/or antimony is provided, including the step of adding magnesium or calcium to the molten aluminum maintained at a temperature of 650° to 850° C. while blowing chlorine gas or a chloride thereinto, to remove the phosphorus and/or the antimony contained in the molten aluminum.

5 Claims, 2 Drawing Sheets

METHOD OF ELIMINATING PHOSPHORUS AND/OR ANTIMONY FROM MOLTEN ALUMINUM

BACKGROUND OF THE INVENTION

1. Field of the Invention

The present invention relates to a method of effectively eliminating phosphorus and/or antimony from molten aluminum made from a raw material containing phosphorus and/or antimony, such as non-reclaimed aluminum mass usually containing not less than 5 ppm of phosphorus or aluminum scraps, the method being applicable to a typical refining process.

2. Description of the Related Art

Recently, appeal for recycling of resources is becoming more and more intensive with increasing public opinion on environmental issues. In view of this, laws concerning recycling have been enforced in some countries including Japan. Accordingly, the industrial world is required to take measures for recycling without delay. The reclaimed aluminum industry has been positively promoting recycling of aluminum since the time before such a recycling movement arose. As a result, the proportion of aluminum scraps, such as city wastes and burr materials, included in the raw materials to be reclaimed is increasing.

Among various aluminum alloys, for example, hypoeutectic or eutectic Al-Si castings and aluminum alloys for diecasting having superior castability, strength and wear resistance such as AC3A, AC4A, AC4B, AC4C, AC8A and AC8B prescribed by Japanese Industrial Standard (JIS) can be modified by refining eutectic silicon therein with use of a modifier such as Na, Sb or Sr. Such modified alloys are used in great quantities as materials for component parts of vehicles such as brake drums, crank cases and pistons as well as of industrial machines, aircraft, household electric appliances and the like. Since these hypo-eutectic or eutectic Al-Si alloys have a broader allowable range of impurity elements, a great quantity of aluminum scrap is used to form a molten aluminum in the production of such an alloy. In the production of AC4CH, which is used in a great quantity for important safety-ensuring parts such as vehicle wheels, non-reclaimed aluminum mass is used in a large amount because AC4CH has a narrower allowable range of impurity elements.

Even a non-reclaimed aluminum mass having a purity of not less than 99.7%, which is often used industrially, contains phosphorus in an amount of about 5 to 15 ppm, and a Cu material and an Si material to be added in the production of an aluminum alloy also contain phosphorus. Accordingly, an aluminum alloy produced using such a non-reclaimed aluminum mass as a raw material contains phosphorus in an amount of about 5 to 20 ppm. Examples of aluminum scraps for use as raw materials of reclaimed aluminum include an aluminum scrap comprising an aluminum plate or sheet plated with Ni—P, a hyper-eutectic Al—Si alloy containing phosphorus as added, an aluminum can, and vehicle parts of cast aluminum. Such aluminum scraps contain phosphorus and other impurities. Aluminum materials supplied as scraps generally contain phosphorus in an amount of about 5 to 100 ppm or more. Further, a Cu material and an Si material added in the production of an aluminum alloy also contain phosphorus. Thus, the content of phosphorus contained in resulting reclaimed aluminum is inevitably high.

When the content of phosphorus in an aluminum material is 5 to 10 ppm or more, refinement of eutectic Si is inhibited despite addition of a modifier, such as Na or Sr, and, hence, the efficacy of the modifier in enhancing the strength or the like is significantly reduced. An aluminum alloy made from such an aluminum material is unsuitable for casting or diecasting, will show an undesired etched state when subjected to a chemical treatment, will provide a product having a degraded surface quality, will cause a larger sink when cast, and suffers other problems caused by phosphorus.

As described above, phosphorus is an element affecting aluminum alloys for casting or diecasting. The mechanical properties, such as elongation and impact value, of such an aluminum alloy are improved when the content of phosphorus therein is not more than 5 ppm, more preferably not more than 3 ppm. Thus, reducing the content of phosphorus is critical in improving the quality of reclaimed aluminum.

Examples of presently known prior art approaches to overcome the foregoing problems include a method as described in Japanese Patent Laid-Open Gazette No. HEI 4-276031 wherein a molten aluminum at a specified temperature is filtered to remove Al—P compounds, and a method as described Japanese Patent Laid-Open Gazette No. HEI 7-2073066 wherein oxygen together with MgO is blown into a molten aluminum to produce a phosphorus oxide or a double oxide of P—Mg, which in turn is separated off. Any one of these methods is not economic due to a large loss of aluminum and requires too much time to filter off such Al—P compounds, phosphorus oxide or double oxide of P—Mg. For this reason, such methods are experimentally possible but have a poor feasibility as a fatal flaw because they are not applicable to any actual mass production.

Elements acting to deteriorate the mechanical properties of an aluminum alloy include antimony as well as phosphorus. Antimony is used as an additive for refinement of eutectic Si, and it is possible that aluminum scraps containing antimony are included in the casting materials. Antimony hinders the modifying effect of a modifier, such as Na or Sr, and hence is responsible for detective cast products having a sink or a reduced strength. Heretofore, a method of eliminating antimony from molten aluminum has not existed. Accordingly, all the aluminum alloys prepared from molten aluminum having inclusion of antimony have been judged as defective products, thus resulting in an increased cost. In addition, it has been impossible to completely separate aluminum scraps containing antimony from the casting materials.

Accordingly, it is an object of the present invention to provide a phosphorus and/or antimony eliminating method which can reduce a metal loss and does not require any filtering process, thereby ensuring a higher productivity.

SUMMARY OF THE INVENTION

According to the present invention, there is provided a method of eliminating phosphorus and/or antimony from molten aluminum containing phosphorus and/or antimony, comprising the step of adding magnesium or calcium to the molten aluminum maintained at temperature of 650° to 850° C. while blowing chlorine gas thereinto, to remove the phosphorus and/or the antimony contained in the molten aluminum.

According to the present invention, there is also provided a method of eliminating phosphorus and/or antimony from molten aluminum containing phosphorus and/or antimony, comprising the step of adding magnesium or calcium to the molten aluminum maintained at temperature of 650° to 850° C. while blowing a chloride thereinto, to remove the phosphorus and/or the antimony contained in the molten aluminum.

In any one of the above methods, magnesium or calcium is added to the molten aluminum for reaction with phosphorus and/or antimony contained therein to produce magnesium phosphide ($Mg_3P_2$) or calcium phosphide ($Ca_3P_2$), or $Mg_3Sb_2$ and a Ca—Sb compound. Further, in the case of the former method, chlorine gas is blown into the molten aluminum for reaction with magnesium or calcium thus added to the molten aluminum to produce $MgCl_2$ or $CaCl_2$, which in turn absorbs magnesium phosphide or calcium phosphide, or $Mg_3Sb_2$ and the Ca—Sb compound produced in the molten aluminum and surfaces to form dross, thereby reducing the contents of phosphorus and/or antimony in the molten aluminum.

Alternatively, in the case of the latter method in which a chloride, such as $MgCl_2$ or $CaCl_2$, is blown into the molten aluminum, the chloride thus blown surfaces while absorbing magnesium phosphide or calcium phosphide, or $Mg_3Sb_2$ and the Ca—Sb compound.

$MgCl_2$ or $CaCl_2$ having absorbed magnesium phosphide or calcium phosphide, or $Mg_3Sb_2$ and the Ca—Sb compound gathers on the surface of the molten aluminum to form dross, which in turn is removed from the molten aluminum. When the temperature of the molten aluminum is not lower than 850° C., magnesium phosphide or calcium phosphide, or $Mg_3Sb_2$ and the Ca—Sb compound becomes finer in the molten aluminum and, as a result, becomes hard to be absorbed by $MgCl_2$ or $CaCl_2$. Consequently, elimination of phosphorus and/or antimony from the molten aluminum becomes difficult. When the temperature of the molten aluminum is lower than 650° C., $MgCl_2$ or $CaCl_2$ turns into a solid state from a molten salt state, with the result that elimination of phosphorus and/or antimony from the molten aluminum becomes difficult.

Examples of such chlorides include $AlCl_3$, NaCl, KCl, $CaCl_2$, $BaCl_2$, LiCl, $MgCl_2$, and $C_2Cl^6$. These may be used either alone or in combination of two or more of them. Though these chlorides are somewhat different in efficacy from each other, they exhibit similar phosphorus and/or antimony eliminating actions.

The foregoing and other objects, features and attendant advantages of the present invention will become apparent from the reading of the following detailed description in conjunction with the attached drawings.

DETAILED DESCRIPTION OF THE PREFERRED EMBODIMENTS

The present invention will now be described in detail by way of examples with reference to the attached drawings.

Figure 1:
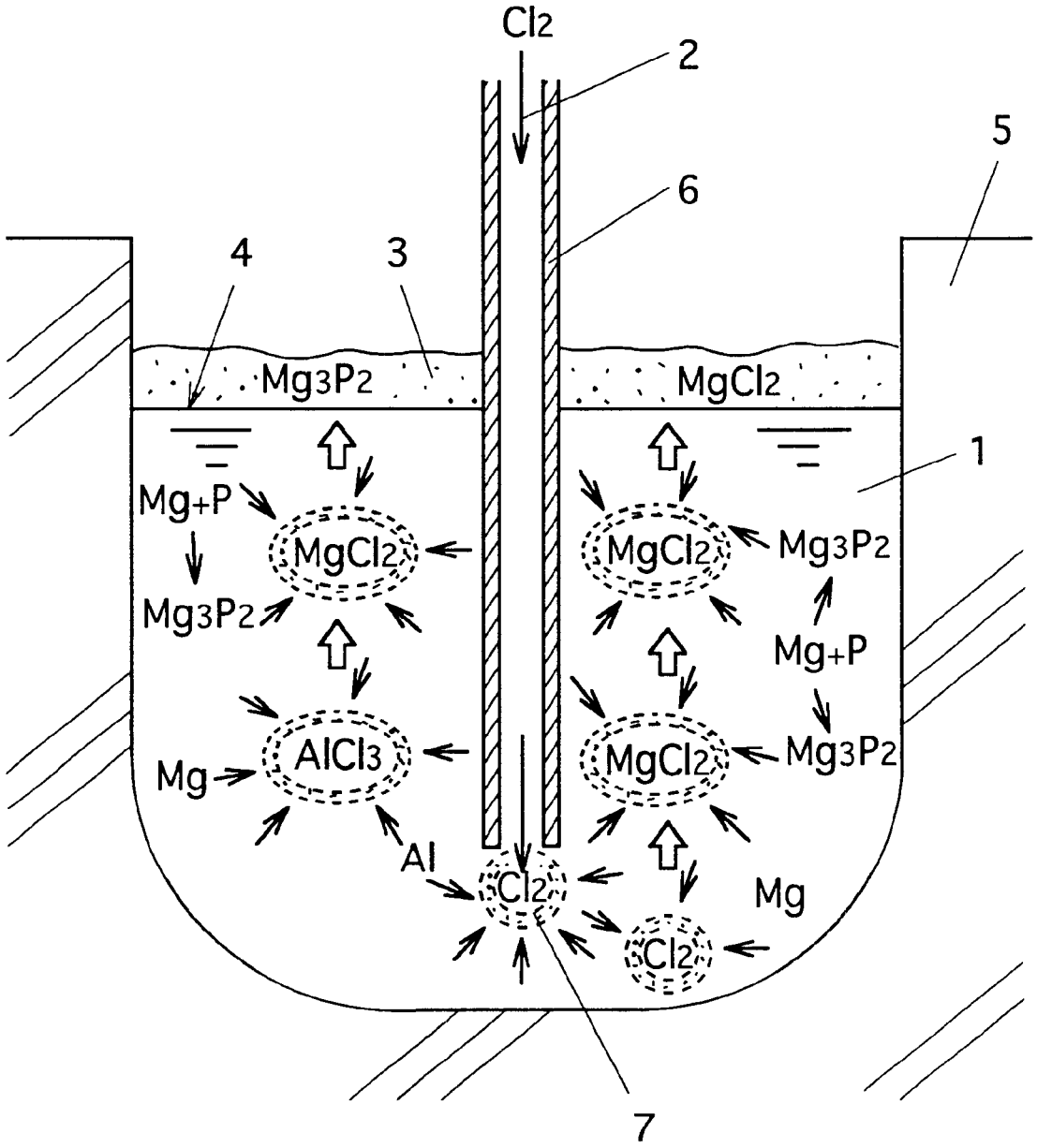
FIG. 1 is a schematic view illustrating reactions occurring in molten aluminum according to the present invention.

First, the phosphorus eliminating effect of the present invention is described below. FIG. 1 is a schematic view illustrating reactions between P (phosphorus) and Mg (magnesium) in molten aluminum 1 according to a representative example of the invention in which Mg is used as an additive and chlorine gas is used as a gas to be blown into the molten aluminum 1. A furnace 5 is filled with the molten aluminum 1 maintained at 650° to 850° C. and containing P in an amount of 5 ppm or more.

When Mg is introduced into the molten aluminum 1, Mg partially reacts with P contained in the molten aluminum 1 to produce $Mg_3P_2$. On the other hand, chlorine blown into the molten aluminum 1 through a lance 6 inserted deeply into the molten aluminum 1 reacts with Mg to produce $MgP_2$, which in turn surfaces while absorbing $Mg_3P_2$ in the molten aluminum 1.

The $Mg_3P_2$ absorption efficiency is related subtly to the diameter of each chlorine bubble, the surfacing speed, and the like and is likely to lower when each chlorine bubble becomes too small or too large. $MgCl_2$ having absorbed $Mg_3P_2$ surfaces and gathers on a molten aluminum surface 4 to form dross, which is then removed. This holds true for the case where Ca is used.

EXAMPLE 1

The relationship between the amount of Mg and the phosphorus eliminating effect was determined. AC4B.1 prescribed by JIS (Japanese Industrial Standard) in an amount of 2.5 kg is melted to prepare molten aluminum, to which Mg was then added, and chlorine gas was blown into the molten aluminum maintained at 700° C. The amount of Mg to be added was varied stepwise in the manner: 0.12 wt %→0.44 wt %→0.66 wt %→0.94 wt %, and the time period for which chlorine gas was blown was also varied, to determine the relationship among the amount of Mg, the chlorine gas blowing time and the reduction in P content. The results are shown in Table 1.

TABLE 1

| Mg Amount added | | Time (min) | | | | | Cl Amount | Cl flow rate |
|---|---|---|---|---|---|---|---|---|
| (%) | | 0 | 30 | 60 | 90 | 120 | (g) | (g/min) |
| 0.12 | Mg Amount (%) | 0.12 | 0.01 | <0.01 | <0.01 | <0.01 | 275 | 2.3 |
| | P Content (ppm) | 9 | 13 | 11 | 13 | 12 | | |
| 0.44 | Mg Amount (%) | 0.44 | 0.15 | 0.01 | | | 135 | 2.3 |
| | P content (ppm) | 15 | 5 | 5 | | | | |
| 0.66 | Mg Amount (%) | 0.66 | 0.51 | 0.38 | | | 120 | 2.0 |
| | P Content (ppm) | 11 | 3 | 1 | | | | |

TABLE 1-continued

| Mg Amount added (%) | | Time (min) 0 | 30 | 60 | 90 | 120 | Cl Amount (g) | Cl flow rate (g/min) |
|---|---|---|---|---|---|---|---|---|
| 0.94 | Mg Amount (%) | 0.94 | 0.78 | 0.66 | 0.58 | 0.49 | 255 | 2.1 |
| | P content (ppm) | 14 | 3 | 2 | 2 | 2 | | |

As seen from Table 1, when the amount of Mg added was 0.12 wt %, Mg was completely consumed in 30 min and the phosphorus eliminating effect was hardly observed. When the amount of Mg was increased to 0.44 wt %, the content of P was reduced from 15 ppm to a normal P content, or 5 ppm in 30 min and, hence, a significant phosphorus eliminating effect was observed, while Mg was substantially completely consumed in 60 min. When the amount of Mg was further increased to 0.66 wt %, the content of P was reduced to 3 ppm, which falls in a low P content region, in 30 min and, hence, an outstanding phosphorus eliminating effect was observed, while Mg was substantially completely consumed in 90 min. When the amount of Mg was further increased to 0.94 wt %, the content of P was reduced to 3 ppm falling in the low P content region in 30 min and, hence, an outstanding phosphorus eliminating effect was observed, while 0.49 wt % of Mg remained unconsumed in the molten aluminum even after 120 min elapsed. This holds true for the case where Ca was used.

It is concluded from the results that: the content of P decreases with increasing Mg amount but the phosphorus eliminating effect scarcely changes when the Mg amount is 0.66 wt % or more; the phosphorus elimination is completed in the initial 30 min if Mg is used in an adequate amount; and the amount of Mg to be added is preferably adjusted in controlling the amount of P to be removed from an aluminum alloy.

EXAMPLE 2

The relationship between the molten aluminum temperature and the phosphorus eliminating effect was determined. AC4B.1 prescribed by JIS in an amount of 2.5 kg is melted to prepare molten aluminum, to which Mg was then added, and chlorine gas was blown into the molten aluminum. The temperature of the molten aluminum was varied in the manner: 650° C.→700° C.→750° C.→800° C., to compare the phosphorus eliminating effects at respective temperatures resulting at the time 30 minutes after the starting of the runs. The amount of Mg added to the molten aluminum and the content of P contained in the molten aluminum before the phosphorus eliminating treatment in one case were substantially equal to respective ones in another case. The results are shown in Table 2.

TABLE 2

| Molten Al Temperature (° C.) | | Time (min) 0 | 30 | Cl Amount (g) | Cl Flow Rate (g/min) |
|---|---|---|---|---|---|
| 650 | Mg Amount (%) | 0.46 | 0.21 | 70 | 2.3 |

TABLE 2-continued

| Molten Al Temperature (° C.) | | Time (min) 0 | 30 | Cl Amount (g) | Cl Flow Rate (g/min) |
|---|---|---|---|---|---|
| | P content (ppm) | 17 | 7 | | |
| 700 | Mg Amount (%) | 0.45 | 0.27 | 65 | 2.2 |
| | P content (ppm) | 18 | 4 | | |
| 750 | Mg Amount (%) | 0.46 | 0.1O | 80 | 2.7 |
| | P content (ppm) | 19 | 5 | | |
| 800 | Mg Amount (%) | 0.43 | 0.02 | 65 | 2.2 |
| | P content (ppm) | 18 | 9 | | |

As seen from Table 2, when the temperature of the molten aluminum was in the range between 700° C. and 800° C., the most excellent phosphorus eliminating effect resulted. When the temperature of the molten aluminum was 800° C., the phosphorus eliminating speed after lapse of 30 min from the start of the treatment was lower. When the temperature of the molten aluminum was 650° C., the phosphorus eliminating speed was lower than that in the case of the temperature ranging between 700° C. and 750° C. but higher than that in the case of 800° C. It is concluded from these results that the molten aluminum temperature at which the phosphorus elimination is practically effective ranges between 650° C. and 850° C. This holds true for the case where Ca was used.

EXAMPLE 3

The relationship between the way of adding Mg and the phosphorus eliminating effect was determined. 25 kg of 99.7% pure aluminum was melted to prepare molten aluminum, to which a large amount of P was experimentally added and Mg was then added. Further, 250 g of magnesium chloride was added to the molten aluminum maintained at 750° C. Mg was added to the molten aluminum by pouring it onto the surface of the molten aluminum, or introducing it deeply into the molten aluminum through a feeder or a phosphorizer. The results of these phosphorus eliminating processes are shown in Table 3.

TABLE 3

| Way of Adding Mg | | Time (min) 0 | 10 | 30 | 60 | 120 | 180 | 240 |
|---|---|---|---|---|---|---|---|---|
| Pouring onto the Surface | Mg Amount (%) | 0.53 | 0.49 | 0.48 | 0.46 | 0.41 | 0.35 | 0.30 |
| | P Content (ppm) | 35 | 32 | 30 | 30 | 27 | 22 | 18 |
| Phosphorizer | Mg Amount (%) | 0.52 | 0.50 | 0.49 | 0.49 | 0.44 | 0.39 | 0.37 |
| | P Content (ppm) | 27 | 25 | 24 | 23 | 19 | 14 | 12 |
| Feeder | Mg Amount (%) | 0.53 | 0.51 | 0.51 | 0.49 | 0.47 | 0.45 | 0.43 |
| | P Content (ppm) | 26 | 23 | 19 | 16 | 13 | 11 | 10 |

As seen from Table 3, when magnesium chloride was poured onto the surface of the molten aluminum, most part of magnesium chloride added turned into dross without contributing to phosphorus elimination though a slight phosphorus eliminating effect was observed with time. In contrast, when magnesium chloride was introduced into the molten aluminum using the phosphorizer or feeder, phosphorus elimination rapidly resulted by the action of magnesium chloride. It is concluded from the foregoing results that the introduction of magnesium chloride deeply into the molten aluminum is effective. This holds true for the introduction of any other chloride.

EXAMPLE 4

The method of the present invention was tested as to whether the method could be practiced on an actual production line. AC4C.1 prescribed by JIS in an amount of 7 tons was melted in a reverberatory furnace to prepare molten aluminum, to which Mg was then added, and chlorine gas was blown into the molten aluminum maintained at 750° C. with use of a lance. The results of this phosphorus eliminating test are shown in Table 4.

TABLE 4

| | Time (min) 0 | 20 | 40 | 60 | Cl Amount (kg) | Cl Flow Rate (kg/min) |
|---|---|---|---|---|---|---|
| Mg Amount (%) | 1.14 | 0.90 | 0.79 | 0.66 | 189 | 3.15 |
| P Content (ppm) | 13.7 | 4.2 | 2.0 | 1.2 | | |
| Molten Al Temp. (° C.) | 741 | 743 | 739 | 734 | | |

As seen from Table 4, when Mg in an amount of 1.14 wt % was added to the molten aluminum, 13.7 ppm of P was reduced to 2.0 ppm in 40 min and to 1.2 ppm in one hour. Thus, 7 tons of molten aluminum was effectively dephosphorized by the method of the invention practiced on the actual production line. This holds true for the case where Ca was used.

EXAMPLE 5

In this example, Ca was used instead of Mg. AC4B.1 prescribed by JIS in an amount of 4.0 kg was melted to prepare molten aluminum, to which Ca was then added, and chlorine gas was blown into the molten aluminum maintained at 700° C. with use of a lance. The results of this phosphorus eliminating process are shown in Table 5.

TABLE 5

| | Time (min) 0 | 60 | 90 | Cl Amount (g) | Cl Flow Rate (g/min) |
|---|---|---|---|---|---|
| Ca Amount (ppm) | 4596 | 62 | 29 | 160 | 1.78 |
| Mg Amount (%) | 0.26 | 0.01 | 0.00 | | |
| P Content (ppm) | 7 | 3 | 3 | | |

As seen from Table 5, Ca in a smaller amount than Mg exhibited a satisfactory phosphorus eliminating effect. Conceivably, this is because Ca has a higher affinity with P than Mg. It is concluded from the results that Ca can be used instead of Mg in eliminating phosphorus from molten aluminum.

EXAMPLE 6

This example proved that phosphorus elimination can be achieved with use of any other chloride than magnesium chloride as used in Example 3. AC4B.1 prescribed by JIS in an amount of 2.5 kg was melted to prepare molten aluminum, to which Ca was then added, and 50 g of ethane hexachloride was added to the molten aluminum maintained at 750° C. The results of this phosphorus eliminating process are shown in Table 6.

TABLE 6

| Ca Amount (%) | | Time (min) 0 | 60 | 120 |
|---|---|---|---|---|
| 0.4 | P Content (ppm) | 24 | 10 | 9 |
| 1.2 | P Content (ppm) | 20 | 10 | 5 |

As seem from Table 6, when Ca was added in an amount of 1.2%, the P content was reduced to 5 ppm in 120 min. The phosphorus eliminating effect is expected to enhance with increasing Ca amount. As can be understood from the results, any chloride such as ethane hexachloride exhibits a potent phosphorus eliminating action.

EXAMPLE 7

$MgCl_2$ and $AlCl_3$ were each used as a chloride in a phosphorus eliminating process so as to be compared with each other as to phosphorus eliminating effect. Parent materials as melted in these cases contained 39 ppm and 34 ppm, respectively, of P and 0.23 wt % of Mg each. Mg was added to each molten parent material to adjust the P content thereof to 0.47 wt % or 0.48 wt %. Then, each of $MgCl_2$ and $AlCl_3$ was increasingly added to each molten material in the manner: 20 g→40 g→60 g→80 g→100 g. The results are shown in Table 7.

TABLE 7

| | | Parent Material as melted | When Mg added | When 20 g added | When 40 g added | When 60 g added | When 80 g added | When 100 g added |
|---|---|---|---|---|---|---|---|---|
| $MgCl_2$ | Mg Amount (%) | 0.23 | 0.47 | 0.42 | 0.38 | 0.33 | 0.29 | 0.25 |
| | P Content (ppm) | 39 | 38 | 34 | 33 | 28 | 28 | 24 |
| | Cl converted Amount (g) | | | 14.9 | 29.8 | 44.7 | 59.6 | 74.5 |
| $AlCl_3$ | Mg Amount (%) | 0.23 | 0.48 | 0.33 | 0.19 | 0.07 | | |
| | P Content (ppm) | 34 | 39 | 34 | 31 | 31 | | |
| | Cl converted Amount (g) | | | 10.6 | 21.2 | 31.8 | | |

As seen from Table 7, in the case where $AlCI_3$ was used, phosphorus elimination was halted halfway due to rapid exhaustion of Mg. In the case where $MgCl_2$ was used, on the other hand, Mg in the molten aluminum was consumed more slowly and, hence, lasting phosphorus elimination was observed.

Figure 2:
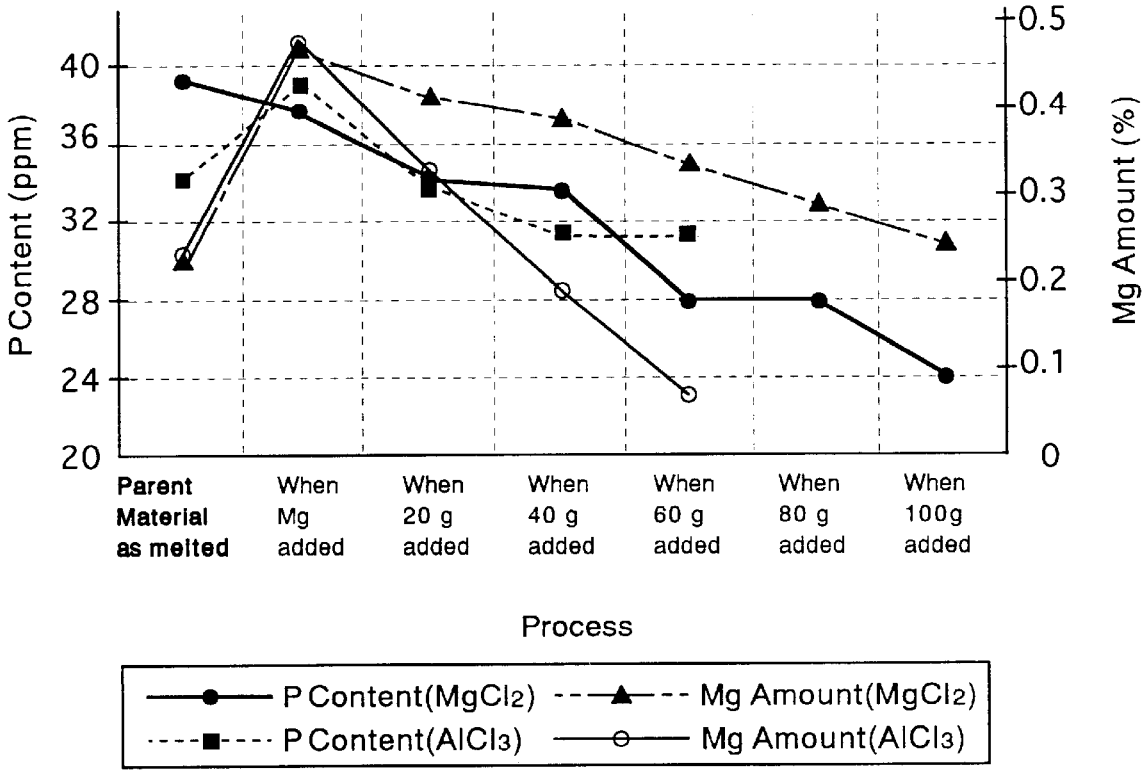
FIG. 2 is a graph showing variations in respective contents of phosphorus and magnesium in the molten aluminum according to the present invention.

FIG. 2 is a graph showing variations in respective amounts of P and Mg contained in the molten aluminum. As shown in FIG. 2, $MgCl_2$ and $AlCl_3$ exhibited respective phosphorus eliminating effects though there was some difference in degree.

Elimination of Sb (antimony) is described below. In each of the following examples, elimination of P and elimination of Sb were effected at a time using a material containing both P and Sb. Since Sb has similar properties to P, Sb contained in molten aluminum can be eliminated by adding Mg to the molten aluminum and blowing chlorine gas into the molten aluminum as in the case of elimination of P.

When Mg is introduced into the molten aluminum, Mg partially reacts with Sb contained in the molten aluminum to produce $Mg_3Sb_2$. On the other hand, chlorine blown into the molten aluminum through a lance inserted deeply into the molten aluminum reacts with Mg to produce $MgCl_2$, which in turn surfaces while absorbing $Mg_3Sb_2$ in the molten aluminum. As in the case of P, the $Mg_3Sb_2$ absorption efficiency is also related subtly to the diameter of each chlorine bubble, the surfacing speed, and the like and is likely to lower when each chlorine bubble becomes too small or too large in diameter. $MgCl_2$ having absorbed $Mg_3Sb_2$ surfaces and gathers on a molten aluminum surface to form dross, which is then removed. This holds true for the case where Ca is used.

EXAMPLE 8

Mg was added to 6 kg of molten aluminum containing 194 ppm of Sb and 47 ppm of P, while chlorine was blown into the molten aluminum at a flow rate of 5 g/min. P and Sb eliminating effects resulting from this test are shown in Table 8.

TABLE 8

| Time (min) | 0 | 10 | 20 | 30 | 40 | 50 |
|---|---|---|---|---|---|---|
| Mg Amount (%) | 0.68 | 0.55 | 0.46 | 0.37 | 0.30 | 0.24 |
| P Content (ppm) | 47 | 16 | 8 | 6 | 3 | 2 |
| Sb Content (ppm) | 194 | 109 | 66 | 37 | 27 | 25 |
| Temperature (° C.) | 753 | 765 | 764 | 766 | 766 | 763 |

As seen from Table 8, the contents of P and Sb in the molten aluminum gradually decreased with time and, after lapse of 50 minutes from the starting of the test, the contents of P and Sb decreased to 2 ppm and 25 ppm, respectively. It can be understood from the results of the test that P and Sb can be eliminated at a time.

EXAMPLE 9

The P and Sb eliminating effect of the present invention was verified using an actual production line. AC4C.2 prescribed by JIS in an amount of 7 tons was melted in a reverberatory furnace to prepare molten aluminum, to which Mg was then added, and chlorine was blown into the molten aluminum at a flow rate of 56 kg/hr. The results of this test are shown in Table 9.

TABLE 9

| Time (min) | 0 | 20 | 40 | 60 | 80 | 100 | 120 | 140 | 160 | 180 |
|---|---|---|---|---|---|---|---|---|---|---|
| Mg Amount (%) | 1.12 | 0.98 | 0.89 | 0.81 | 0.73 | 0.66 | 0.60 | 0.55 | 0.55 | 0.47 |
| P Content (ppm) | 7.8 | 6.6 | 5.9 | 5.2 | 4.4 | 3.2 | 3.1 | 2.1 | 2.0 | 1.8 |
| Sb Content (ppm) | 117 | 112 | 114 | 100 | 87 | 73 | 65 | 48 | 41 | 32 |
| Temp. (° C.) | 781 | 791 | 790 | 761 | 750 | 745 | 732 | 720 | 704 | 700 |

As seen from Table 9, the initial P and Sb contents assuming 7.8 ppm and 117 ppm, respectively, decreased to 1.8 ppm and 32 ppm, respectively, after lapse of 180 minutes from the starting of the test. It can be understood from the results that the present invention is effective in eliminating P and Sb even in an actual production line.

According to the present invention, Mg or Ca is added to the molten aluminum for reaction with P and/or Sb contained therein to produce magnesium phosphide or calcium phosphide, or $Mg_3Sb_2$ and a Ca—Sb compound. Further, chlorine gas or a chloride is blown into the molten aluminum for reaction with Mg or Ca thus added to the molten aluminum to produce $MgCl_2$ or $CaCl_2$, which in turn absorbs magnesium phosphide or calcium phosphide, or $Mg_3Sb_2$ and the Ca—Sb compound produced in the molten aluminum to form dross. Such dross can readily be removed. Thus, the contents of P and/or Sb in the molten aluminum can be reduced easily.

While only certain presently preferred embodiments of the present invention have been described in detail, as will be apparent for those skilled in the art, certain changes or modifications may be made in embodiment without departing from the scope of the present invention as defined by the following claims.

What is claimed is:

1. A method of eliminating phosphorus and/or antimony from molten aluminum containing phosphorus and/or antimony, comprising the step of adding magnesium to the molten aluminum maintained at a temperature of 650° to 850° C. while blowing chlorine gas thereinto, to remove the phosphorus and/or the antimony contained in the molten aluminum.

2. A method of eliminating phosphorus and/or antimony from molten aluminum containing phosphorus and/or antimony, comprising the step of adding magnesium to the molten aluminum maintained at temperature of 650° to 850° C. while blowing a chloride thereinto, to remove the phosphorus and/or the antimony contained in the molten aluminum.

3. A method of eliminating phosphorus and/or antimony from molten aluminum containing phosphorus and/or antimony, comprising the step of adding calcium to the molten aluminum maintained at a temperature of 650° to 850° C. while blowing chlorine gas thereinto, to remove the phosphorus and/or the antimony contained in the molten aluminum.

4. A method of eliminating phosphorus and/or antimony from molten aluminum containing phosphorus and/or antimony, comprising the step of adding calcium to the molten aluminum maintained at temperature of 850° C. while blowing a chloride thereinto, to remove the phosphorus and/or the antimony contained in the molten aluminum.

5. The methond according to claim 2 or 4, wherein the chloride comprises at least one chloride selected from the group consisting of $AlCl_3$, NaCl, KCl, $CaCl_2$, $BaCl_2$, LiCl, $MgCl_2$, and $C_2Cl_6$.

* * * * *

UNITED STATES PATENT AND TRADEMARK OFFICE

CERTIFICATE OF CORRECTION

PATENT NO. : 6,336,955
DATED : January 8, 2002
INVENTOR(S) : Suzuki et al.

It is certified that error appears in the above-identified patent and that said Letters Patent is hereby corrected as shown below:

Title page,
Item [73], the Assignee's information should read:

[73] Assignee: K.K. Daiki Aluminium Kogyosho, Yao [JP]

Item [30], the Foreign Application Priority information should read:

[30] Foreign Application Priority Data

Jun. 22, 2000 [JP] .....2000-188171
Jun. 7, 2001 [JP] .....2001-172897

Signed and Sealed this

Twenty-first Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,336,955 B1
DATED : January 8, 2002
INVENTOR(S) : Takao Suzuki et al.

It is certified that error appears in the above-identified patent and that said Letters Patent is hereby corrected as shown below:

Column 3,
Line 35, "$C_2Cl^6$" should read -- $C_2Cl_6$ --.

Signed and Sealed this

Eighteenth Day of February, 2003

JAMES E. ROGAN
*Director of the United States Patent and Trademark Office*